US012076630B2

(12) United States Patent
Lambrinos

(10) Patent No.: US 12,076,630 B2
(45) Date of Patent: Sep. 3, 2024

(54) SPORT TRAINING BAG ATTACHMENT

(71) Applicant: Jon Lambrinos, Campbell, OH (US)

(72) Inventor: Jon Lambrinos, Campbell, OH (US)

( * ) Notice: Subject to any disclaimer, the term of this patent is extended or adjusted under 35 U.S.C. 154(b) by 207 days.

(21) Appl. No.: 17/937,582

(22) Filed: Oct. 3, 2022

(65) Prior Publication Data

US 2023/0122893 A1 Apr. 20, 2023

Related U.S. Application Data

(60) Provisional application No. 63/255,652, filed on Oct. 14, 2021.

(51) Int. Cl.
*A63B 69/20* (2006.01)
*A63B 69/30* (2006.01)

(52) U.S. Cl.
CPC ..... *A63B 69/305* (2022.08); *A63B 69/30* (2022.08); *A63B 2209/10* (2013.01)

(58) Field of Classification Search
CPC ..... A63B 69/305; A63B 69/30; A63B 69/20; A63B 69/22; A63B 69/222; A63B 69/224; A63B 69/24; A63B 69/244; A63B 69/28; A63B 69/407; A63B 21/02; A63B 21/023; A63B 21/025; A63B 2209/10
See application file for complete search history.

(56) References Cited

U.S. PATENT DOCUMENTS 4,093,212 A 6/1978 Jacques
4,491,315 A 1/1985 Dye
4,946,159 A * 8/1990 Jones ..... A63B 69/22 473/441
5,183,451 A * 2/1993 Hautamaki ..... A63B 69/22 482/129
D641,811 S 7/2011 Brenner et al.
D641,812 S 7/2011 Brenner et al.
9,017,227 B1 * 4/2015 Vargas ..... A63B 69/22 482/89
9,211,465 B1 * 12/2015 Lambrinos ..... A63B 69/22
9,814,959 B1 * 11/2017 Riera ..... A63B 69/24
11,583,744 B1 * 2/2023 Hayes ..... A63B 69/20
2008/0032872 A1 2/2008 Nappier
2009/0264264 A1 10/2009 Reen
(Continued)

FOREIGN PATENT DOCUMENTS

CN 206198533 U * 5/2017
GB 2509307 A * 7/2014 ..... A63B 21/022
(Continued)

OTHER PUBLICATIONS

STIC Search Request Results from Jun. 5, 2024 (Year: 2024).*

*Primary Examiner* — Megan Anderson
*Assistant Examiner* — Jonathan A Dicuia
(74) *Attorney, Agent, or Firm* — Harpman & Harpman

(57) ABSTRACT

A training bag attachment for a suspended heavy bag for training boxing techniques, specifically but not limited an upper cut that requires an elevated and preferably suspended target. The training bag attachment provides a human head analog target representation, flexible resistant to impact. The target head bag extends from a resilient adjustable mounting assembly which is selectively secured to the bag's target. The target provides for automatic resilient return displacement after impact, affording a user multiple continuous resetting target configuration.

6 Claims, 5 Drawing Sheets

(56) References Cited

U.S. PATENT DOCUMENTS

| | | | | |
|---|---|---|---|---|
| 2014/0148314 | A1* | 5/2014 | Schlicher | A63B 21/169<br>482/87 |
| 2021/0402276 | A1* | 12/2021 | Peyton | A63B 69/305 |
| 2022/0212076 | A1* | 7/2022 | Rita | A63B 21/1645 |

FOREIGN PATENT DOCUMENTS

| | | | |
|---|---|---|---|
| KR | 20100128378 | A * | 12/2010 |
| WO | WO94/28981 | | 12/1994 |

* cited by examiner

SPORT TRAINING BAG ATTACHMENT

This application claims the benefit of U.S. Provisional Application No. 63/255,652, filed Oct. 14, 2021.

BACKGROUND OF THE INVENTION

1. Technical Field

This invention relates to sport training, specifically boxing punching bags to provide for repetitive hitting by users to improve their accuracy and skill.

2. Description of Prior Art

Prior art devices of this type directed to boxing training for specific types of punching have been developed; see for example U.S. Pat. Nos. 4,093,212, 4,491,315, Design Pat. Nos. D641,811 and D641,812, and U.S. Publications 2008/0032872A1, and 2009/02642644A1 and PCT Application WO94/28981.

SUMMARY OF THE INVENTION

A training attachment for boxing equipment that is removably secured to a boxing heavy bag having one or more positioned independent target punching head representations for practice, including upper cuts. A resilient target bag representation and independent target bag assembly extends outwardly from an adjustable positioning bag engagement mount support assembly, which has a horizontal bag engagement retainment strap with a vertical positioning strap extending to the bag for support. Target bag disposition and return is induced by a resilient interior mounted element there within while the independent target bag absorbs engaging impact and displacement.

DESCRIPTION OF THE PREFERRED EMBODIMENT

Figure 1:
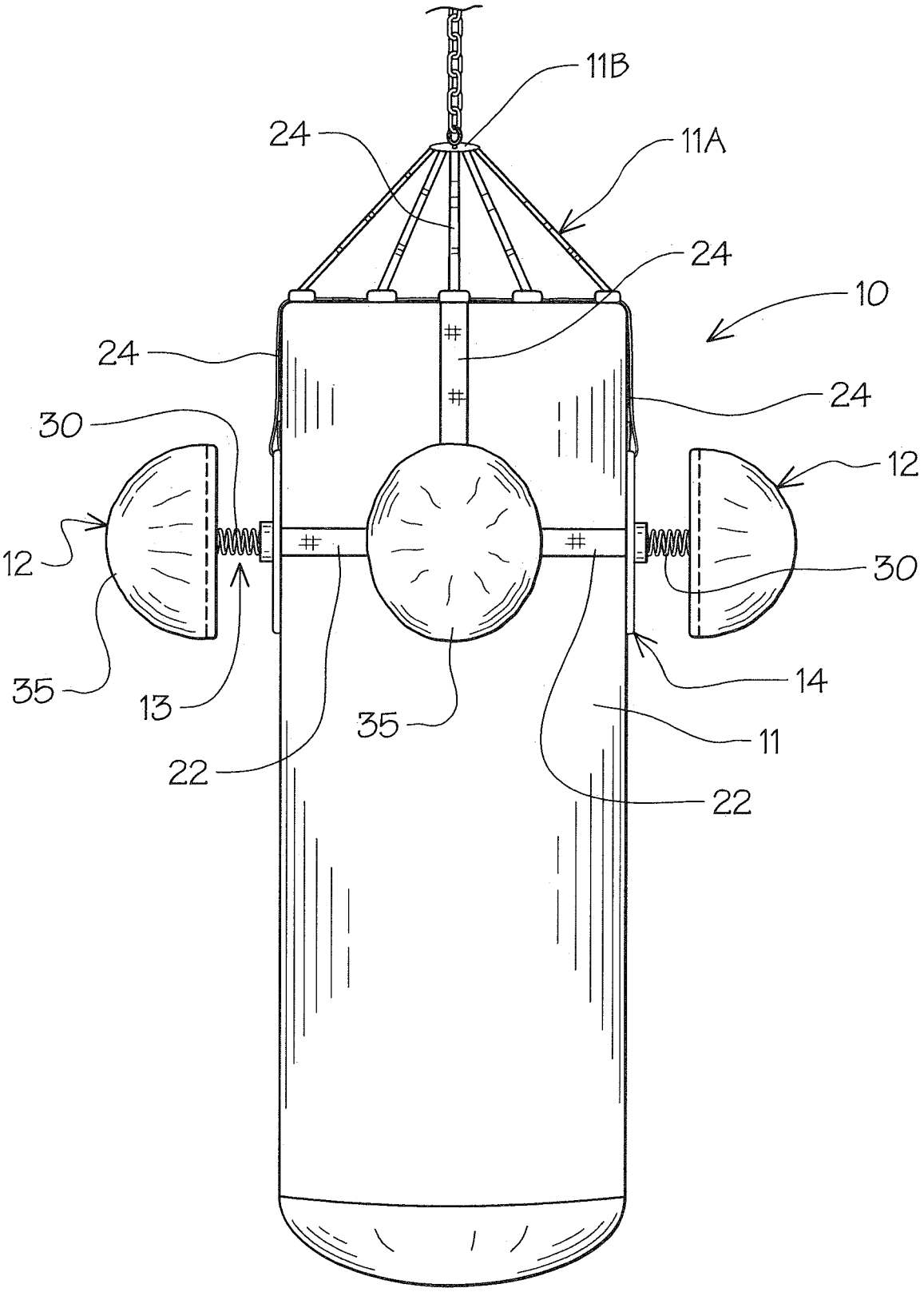
FIG. 1 is a front elevational view of the boxing bag attachment on a suspended heavy boxing bag.
Figure 5:
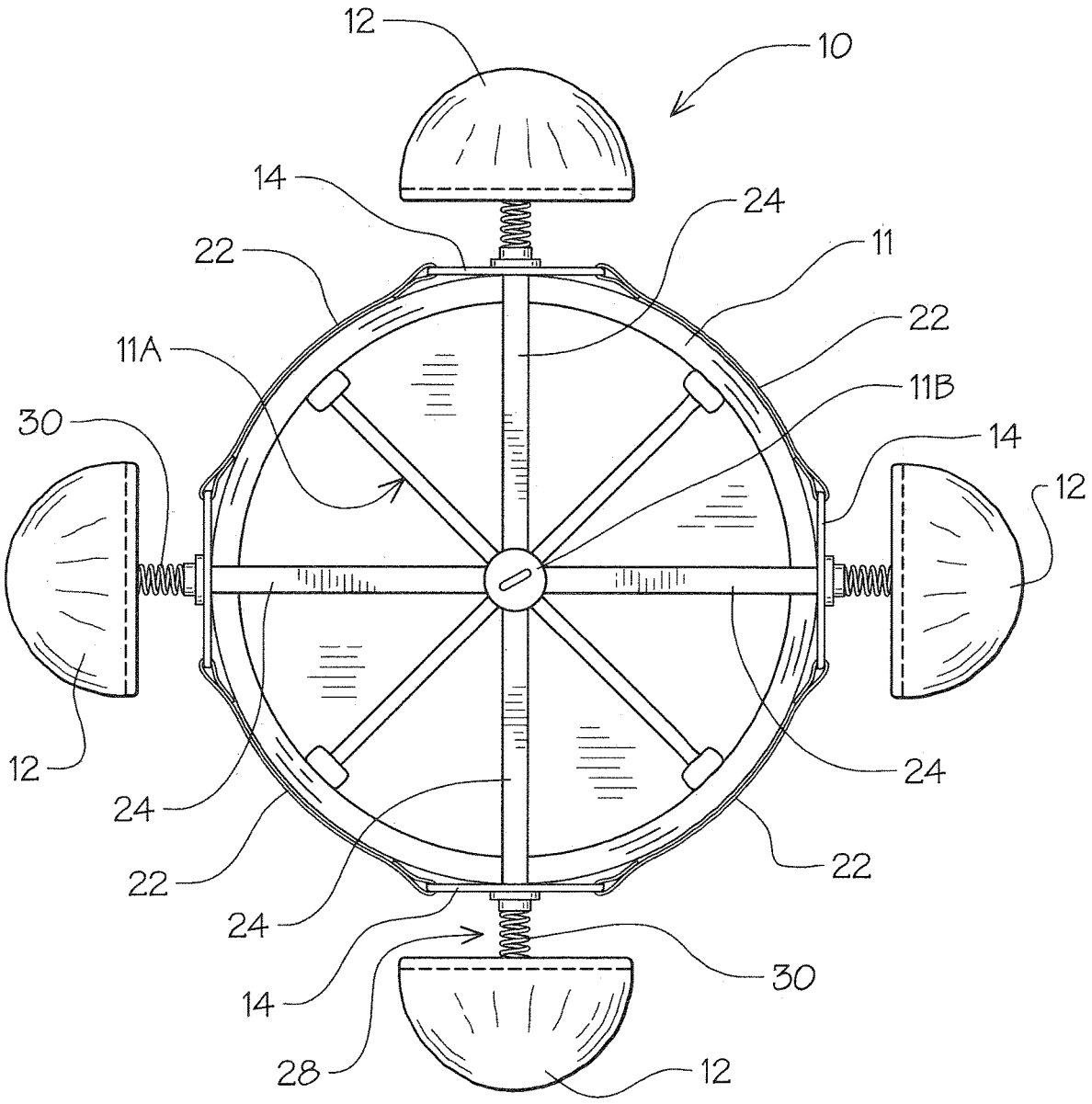
FIG. 5 is a top plane view of the heavy bag with multiple target assemblies attached thereto.

A training attachment 10 for boxing equipment that is adjustably secured to a boxing heavy bag 11 as seen in FIGS. 1 and 5 of the drawings having a multi-strap suspension system 11A with a support ring and a center support line 11B extending therefrom as is typical and known in the art. At least one human head analog punching target bag 12 is positioned for practicing punching techniques, including upper cuts is provided. The punching head target bag 12 has a resilient stabilization and return assembly 13 to assure proper target presentation and automatic return after striking, as will be described in greater detail hereinafter.

Figure 2:
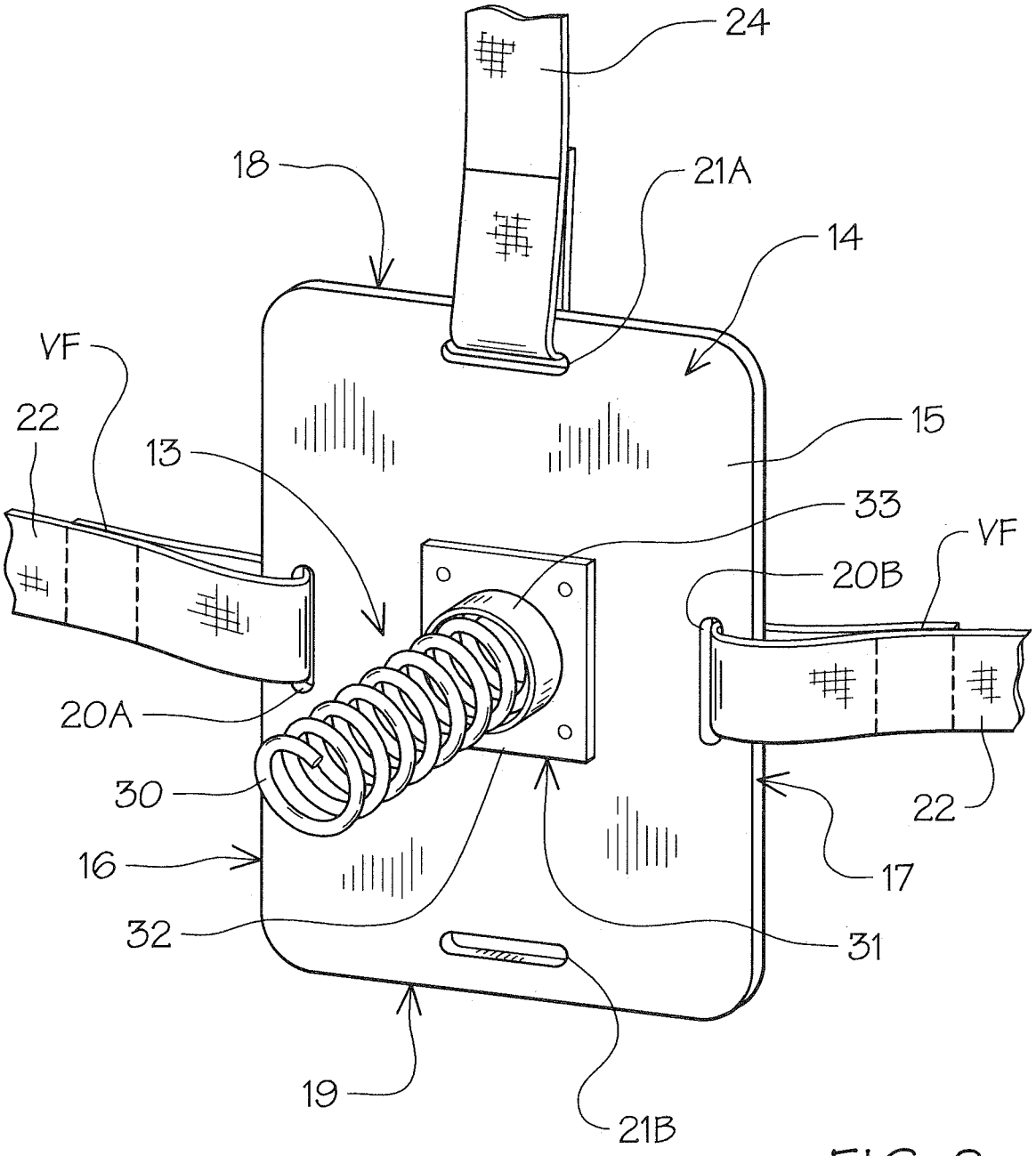
FIG. 2 is an enlarged perspective partial view of the boxing bag mount.
Figure 3:
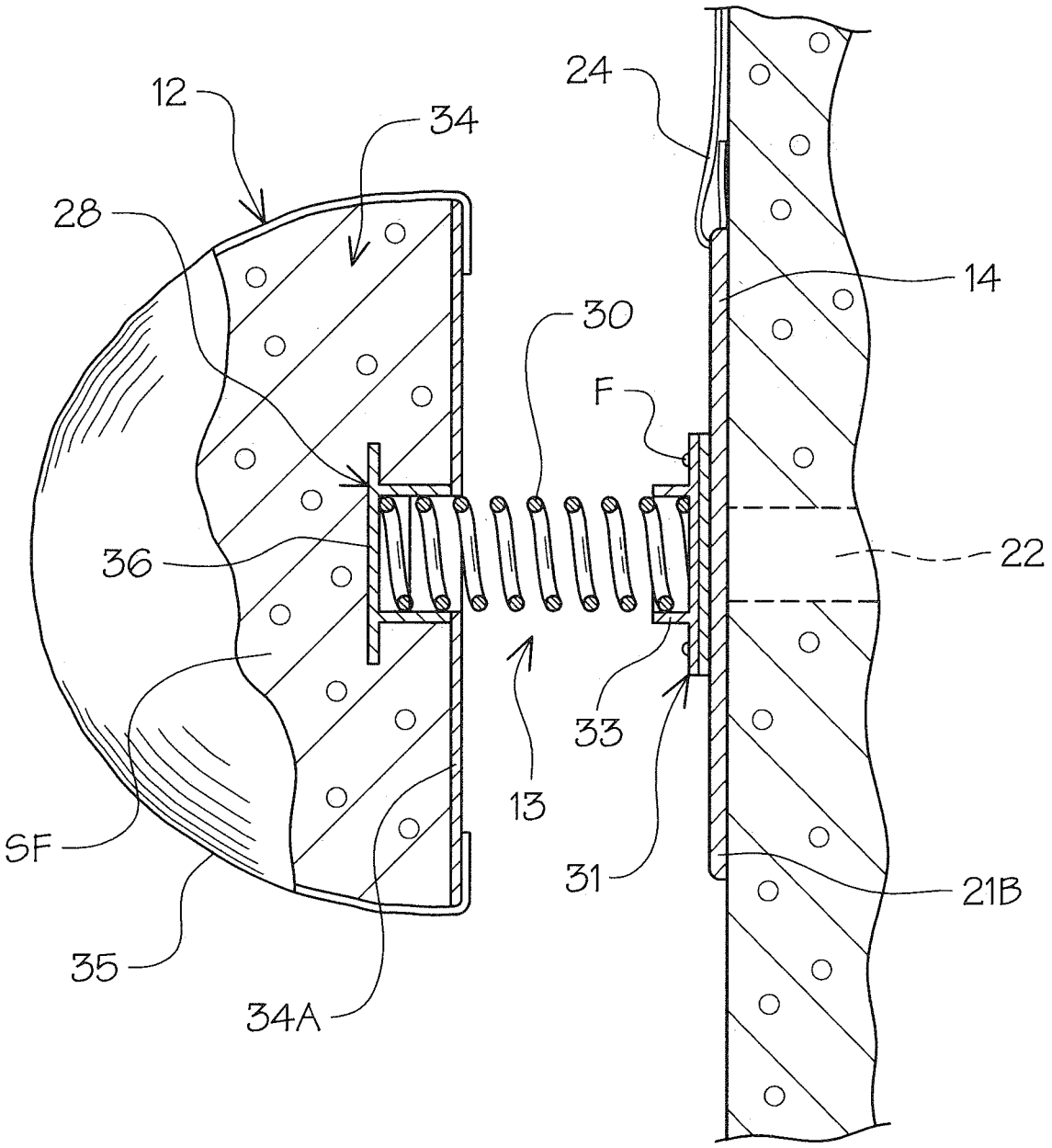
FIG. 3 is an enlarged sectional view of the boxing bag attachment with portions broken away.
Figure 4:
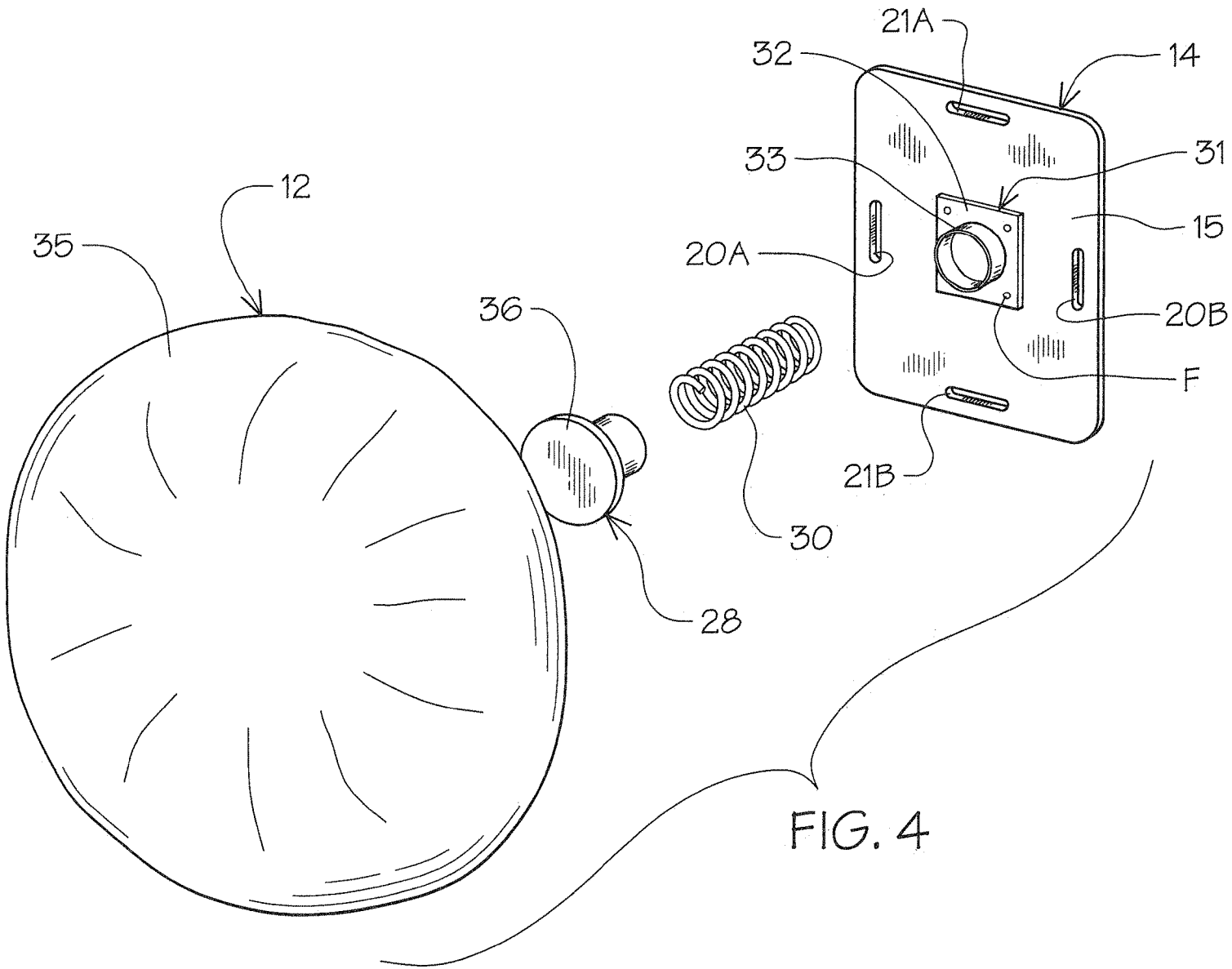
FIG. 4 is an exploded perspective view of the target assembly of the invention.

An adjustable target mounting attachment 14 for the heavy bag 11, best seen in FIGS. 2, 3 and 4 of the drawings, comprised of a thin flat flexible mounting base 15 having oppositely disposed space parallel perimeter side edges 16, 17 with interconnecting top and bottom perimeter edges 18, 19. Strap attachments slots 20A, 20B and 21A, 21B are formed within the base 15 between the respective intersections of the perimeter edges 16, 17 and 18, 19 respectively. Mounting engagement straps 22 are secured through and extend from the hereinbefore described corresponding slots 20A and 20B so as to provide a horizontal bag encompassing strap securing the target mounting attachment 14 to the heavy bag 11, as seen in FIG. 1 of the drawings. The respective straps 22 extends around the heavy bag 11 and through their corresponding aligned slots 20A and 20B and may extend back upon themselves with their free ends having sections of hook and loop fasteners VF secured longitudinally thereon so as to provide an inter-engagement with hook and loop material VF' thereon selectively interlocking as best seen graphically in FIG. 2 of the drawings around the perimeter of the heavy bag 11.

Multiple adjustable vertical placement suspension straps 24 extends from each centered top perimeter edge slot 21A up and over the top of the heavy bag 11 intersecting one another as seen in FIG. 5 of the drawings.

The human head analog punching target bag 12 is secured centrally to the adjustable target attachment 14 by an interior support spring assembly 28 with a spring 30 extending therefrom. The spring 30 extends to a target insert support 31 having spring-engagement base 32 with an integral upstanding sleeve fitting 33 on the target attachment 14, as best seen in FIGS. 2, 3 and 4 of the drawings. The springs 30 are of a determined resilient value which when under target impact impart a unique resistant natural movement to the target bag 12, as will be described hereinafter.

The target bag 12 defines a target cushion 34 having a rigid back support brace 34A with overlying contoured cover 35 filled with dense synthetic resilient foam SF for a yielding striking surface, best seen in FIGS. 1, 3 and 4 of the drawings.

The target spring insert support 31 is secured to the target mounting attachment 14 by fasteners F thereby defining the upstanding mounting sleeve fitting 33 on the mounting base 15. The attached target cushion 34 has a central spring receiving recess sleeve mount 36 which allows the spring assembly 28 to be secured therein.

It will be seen that in use that the spring assembly 28 will allow for yielding return movement of the target cushion 34 as a human head analog punching target 12 with greater side to side travel than up and down movement indicated by broken arrows under impact by the user, not shown, for enhanced return movement so as to emulate a more human analog movement and assist in rapid repositioning of the target for the next impact assuring a continuous work out sequence of the user.

The horizontal and vertical strap mounting orientation allows for multiple target assemblies 14 to be selectively positioned around the heavy boxing bag 11. The mounting spring assemblies 28 are secured centrally to and extends from the mounting base 15. As noted, the target bag 12 defined by the target cushion 34 is secured over and integrated onto spring mounting assembly 28 so as to transfer absorbent impact energy imparted against the target bag 12 during use as a boxing training device. The punching target bag 12 has an ovaloid shape with a contoured padded main body 37 as hereinbefore described. The punching target bag 12 secured over and integrated onto the spring mounting assembly 28 so as to transfer and absorb impact energy imparted against the target bag 12 during use as a boxing training device.

The spring 30 orientation and end mounting sleeve 33 of the mount is at 90 degrees from the target attachment 14 combined with the target bag 12's conical and curvilinear construction allows for energy absorption and transfer with minimal translateral bag displacement during impact without target orientation displacement, therefore eliminating excessive target rebound improving and emulating humanoid contact reaction to impact more effectively.

Given the above-referred description, it will be seen that a new and novel human head analog sports training bag attachment 10 has been illustrated and described and will be apparent to those skilled in the art that various changes and modifications may be made thereto without departing from the spirit of the invention.

Therefore I claim:

1. A sport training attachment for a boxing bag comprises, a mounting base adjustably positioned on said boxing bag, a punching target secured to and extends from said mounting base, a support spring assembly extending from said punching target to said mounting base, multiple straps securing said mounting base on said boxing bag in both horizontal and vertical axis.

2. The sport training attachment for a boxing bag set forth in claim 1 wherein said mounting base is of a thin, flat, flexible configuration having multiple mounting slots therein.

3. The sport training attachment for a boxing bag set forth in claim 1 wherein said support spring assembly comprises, a resilient spring secured within and extending from said punching target.

4. The sport training attachment for a boxing bag set forth in claim 1 wherein said mounting base further comprises, a spring engagement base, a sleeve fitting for receiving and securing said spring assembly therein.

5. The sport training attachment for a boxing bag set forth in claim 1 wherein said multiple straps comprises, horizontally aligned mounting base engagement straps on said bag and annular spaced vertically aligned mounting base engagement straps extending there between.

6. The sport training attachment for a boxing bag set forth in claim 5 wherein said horizontally aligned mounting base engagement straps respective free ends have hook and loop fasteners for overlapping resilient attachment upon themselves.

* * * * *